US006283457B1

(12) United States Patent
Venegas, Jr.

(10) Patent No.: US 6,283,457 B1
(45) Date of Patent: Sep. 4, 2001

(54) HAND RAIL SYSTEM

(76) Inventor: Frank Venegas, Jr., 4165 Homestead, Howell, MI (US) 48843

( * ) Notice: Subject to any disclaimer, the term of this patent is extended or adjusted under 35 U.S.C. 154(b) by 0 days.

(21) Appl. No.: 09/394,595

(22) Filed: Sep. 13, 1999

Related U.S. Application Data

(63) Continuation-in-part of application No. 08/870,101, filed on Jun. 5, 1997, now abandoned.

(51) Int. Cl.[7] ..... E04H 17/14
(52) U.S. Cl. ..... 256/65; 256/59; 256/19
(58) Field of Search ..... 256/59, 65, 66, 256/68, 19, 25

(56) References Cited

U.S. PATENT DOCUMENTS

| | | | | |
|---|---|---|---|---|
| 634,066 | | 10/1899 | Parker et al. | 49/396 |
| 1,192,592 | | 7/1916 | Winter | 49/381 |
| 2,767,494 | | 10/1956 | Peterson | 49/394 X |
| 4,201,411 | | 5/1980 | Morgan | 49/381 X |
| 4,930,754 | * | 6/1990 | Caron et al. | 256/65 |
| 5,312,089 | * | 5/1994 | Venegas, Jr. | 256/65 |
| 5,364,077 | * | 11/1994 | Venegas, Jr. et al. | 256/65 X |
| 5,421,666 | | 6/1995 | Spears | 403/169 X |
| 5,480,126 | * | 1/1996 | Teasdale | 256/19 |
| 5,566,927 | | 10/1996 | Venegas, Jr. | 256/59 |
| 6,131,886 | * | 10/2000 | Venegas, Jr. | 256/59 |

* cited by examiner

*Primary Examiner*—Lynne H. Browne
*Assistant Examiner*—John R. Cottingham
(74) *Attorney, Agent, or Firm*—Gifford, Krass, Groh, Sprinkle, Anderson & Citkowski, PC

(57) ABSTRACT

The present invention provides a knockdown hand rail assembly that is formed of both metal and plastic. The hand rail assembly is readily and easily assembled and disassembled. The hand rail assembly is maintenance free and requires no paint or other upkeep. The assembly can be used in many applications both indoor and out. The hand rail assembly includes at least two spaced apart vertical rails, two base supports for supporting the vertical rails in an upright position and at least two spaced apart horizontal rails removably engaged with the vertical rails and positioned above the base supports. Each rail is surrounded by removable and replaceable polymerized sheathing having an interior diameter equal to or greater than the outer diameter of the rail. Each rail is also removably engaged to another rail by a slip-on structural fitting that preferably removably secures the rails by set screws.

21 Claims, 6 Drawing Sheets

HAND RAIL SYSTEM

REFERENCE TO RELATED APPLICATION

This is a continuation-in-part of U.S. patent application Ser. No. 08/870,101, filed Jun. 5, 1997, now abandoned the entire contents of which are incorporated herein by reference.

Field of the Invention

The present invention is directed to a knock-down hand rail system. More particularly, the present invention relates to a unique knock-down hand rail system for use both indoors and outdoors.

Background of the Invention

The typical hand rail is formed of metal and susceptible to affects of weather or other environmental conditions causing the rail to rust and deteriorate. A disadvantage of these metal rails is that such rails require regular upkeep such as painting to prevent rust or complete replacement when the metal rusts away.

To overcome this, galvanized steel has been used to avoid rust and hopefully, eliminate regular upkeep. A disadvantage of galvanized steel is that the sheen is too bright and is distracting when used in environments such as auditoriums or stadiums.

A still further disadvantage of both the metal and galvanized steel hand rail systems is that their assembly is of a permanent nature. That is, once the rail structure is assembled, the rail is permanently fixed at that location in that configuration.

SUMMARY OF THE INVENTION

The present invention provides a knock-down hand rail assembly that is formed of both metal and plastic. The hand rail assembly is readily and easily assembled and disassembled. The hand rail is maintenance free and requires no paint or other upkeep.

The assembly of the present invention can be used in many applications both indoor and out. The hand rail assembly can readily be assembled anywhere. The assembly can also readily be disassembled to form a different hand rail structure configuration or to add more rails to the structure. Further, the hand rail can be readily disassembled to change the plastic for the purpose of changing colors of the rail or adding/subtracting signage provided on the structure. This is advantageous when using the invention in an auditorium setting. The ability to color code railings with seating makes it easier on attendees to find their seats during a game or show. The knock down hand rail assembly of the present invention includes at least two spaced apart vertical rails and at least two base supports for supporting the vertical rails in an upright position. Alternatively, the vertical rails may be supported by the ground using standard coring procedures. At least two spaced apart horizontal rails are provided and removably engaged with the vertical rails. These horizontal rails are preferably positioned above the base supports. Each vertical and horizontal rail is surrounded by removable and replaceable polymerized sheathing. The polymerized sheathing has an interior diameter equal to or greater than the outer diameter of each rail. Slip-on structural fittings are provided to removably engage the horizontal rails to the vertical rails.

In other preferred embodiments, a plurality of vertical and horizontal rails surrounded by polymerized sheathing and engaged by slip-on structural fittings can be used. These and other objects, advantages and features of this invention will become apparent upon review of the following specification in conjunction with the drawings.

DESCRIPTION OF THE INVENTION

Figure 1:
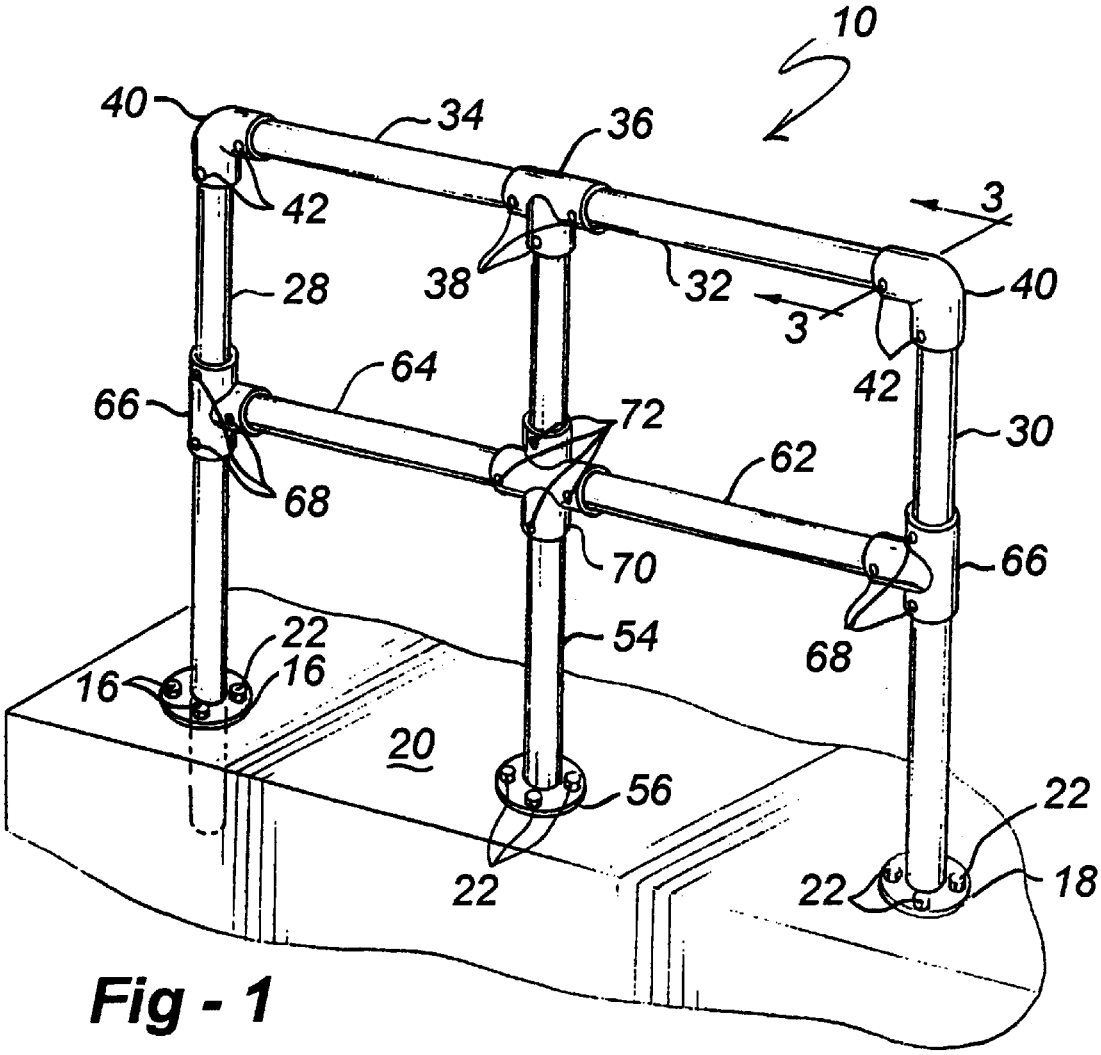
FIG. 1 is a perspective view of the hand rail assembly of the present invention.
Figure 2:
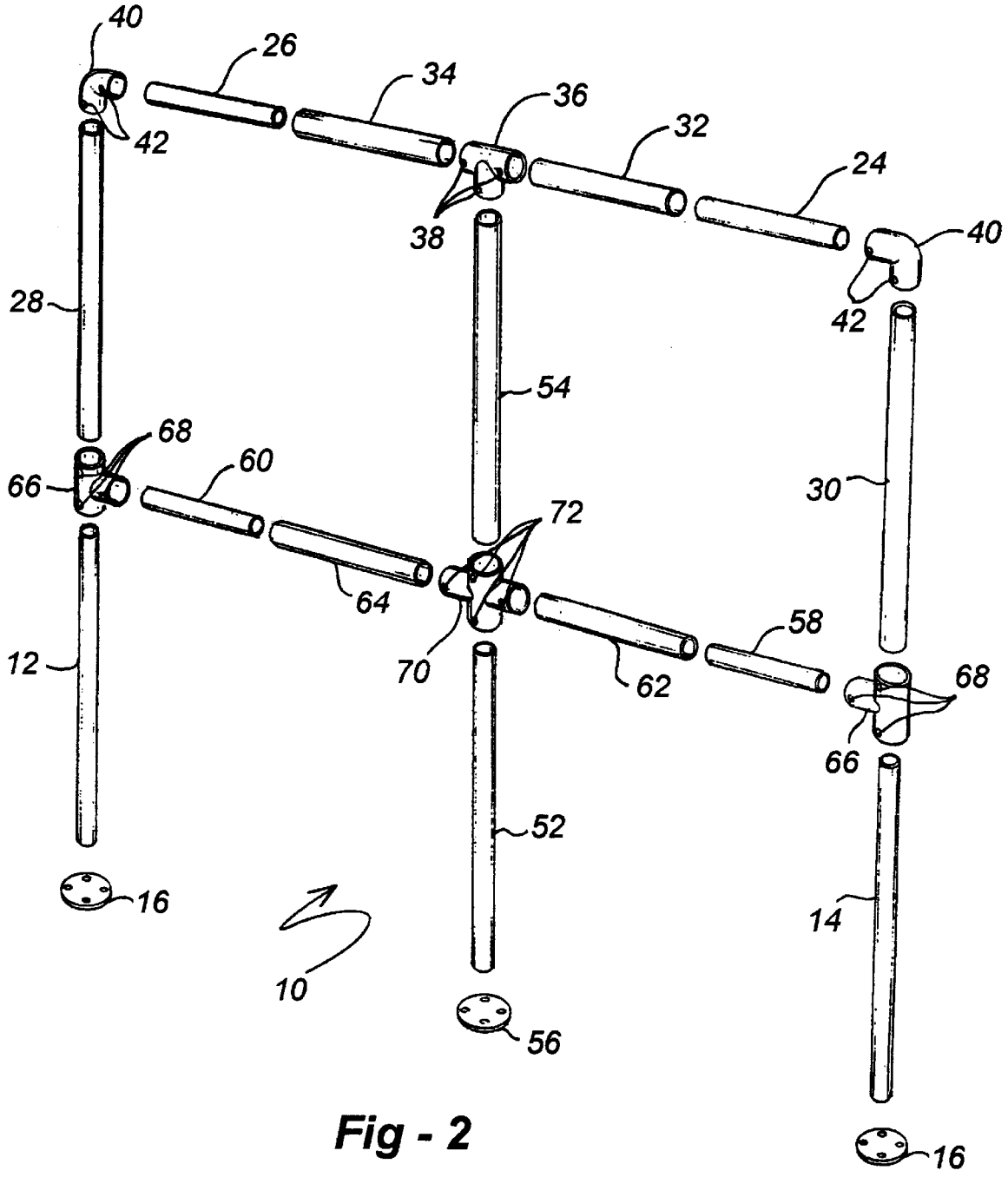
FIG. 2 is an exploded view of a preferred embodiment of the hand rail assembly of the present invention.

With reference to FIGS. 1 and 2, a knock down hand rail system 10 is thereshown. In this first preferred embodiment, at least two spaced apart vertical rails 12, 14 are provided and supported in an upright position by base supports 16, 18. These base supports 16, 18 provide removable and replaceable support with the ground 20 and are preferably secured to the ground 20 by bolts 22. Alternatively, the hand rail assembly can be cored to the ground for support.

The hand rail assembly of the present invention also includes at least two spaced apart horizontal rails 24, 26 removably engaged with vertical rails 12, 14 and positioned above base supports 16, 18.

As shown in FIG. 2, vertical rails 12, 14 are surrounded by removable and replaceable polymerized sheathing 28, 30. This sheathing 28, 30 preferably slip fits about vertical rails 12, 14 and has an interior diameter equal to or greater than the exterior diameter of vertical rails 12, 14. This aspect of the invention will be described in greater detail below.

As with vertical rails 12, 14, corresponding horizontal rails 24, 26 are also surrounded by polymerized sheathing 32, 34 respectively. Additionally, this polymerized sheathing has an interior diameter that is equal to or greater than the exterior diameter of horizontal rails 24, 26. As stated above, this slip fit of the polymerized sheathing 32, 34 about horizontal rails 24, 26 will be described in detail later.

Slip-on structural fittings 36, 40 are provided to removably engage horizontal rails 24, 26 to each other and to vertical rails 12, 14. These slip-on structural fittings are preferably Hollaender structural fittings manufactured by The Hollaender Manufacturing Company, Cincinnati, Ohio. T-shaped slip-on structural fitting 36 may be provided to join horizontal rail 24 to horizontal rail 26 and include an extra opening for additional vertical rails if desired. T-shaped slip-on structural fitting 36 removably engages horizontal rails 24, 26 and polymerized sheathing 32, 34 by set screws 38.

L-shaped Hollaender slip-on structural fittings 40 removably engage horizontal rails 24, 26 to vertical rails 12, 14.

L-shaped slip-on structural fittings 40 removably secure the rails to each other by set screws 42.

Figure 3:
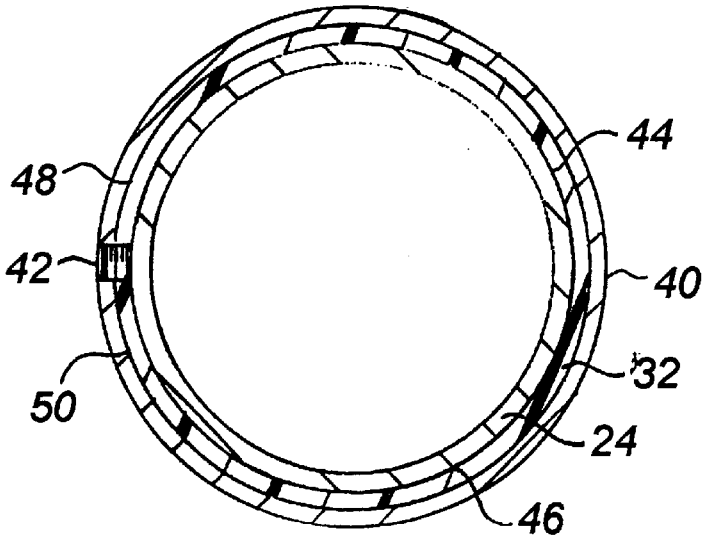
FIG. 3 is a cross-sectional view taken along line 3—3 of FIG. 1.

With reference to FIG. 3, each slip-on structural fitting provided to removably secure the knockdown hand rail system 10 of the present invention typically includes a structural fitting 40 for securing horizontal rail 24 with polymerized sheathing 32 to vertical rail 14 with polymerized sheathing 30. More specifically, interior diameter 44 of polymerized sheathing 32 is equal to or greater than exterior diameter 46 of horizontal rail 24. Additionally, interior diameter 48 of L-shaped slip-on fitting 40 is equal to or greater than the exterior diameter 50 of polymerized sheathing 32. Set screw 42 is preferably a counter bore knurled cup point set screw that securely fastens L-shape slip-on fitting 40 through polymerized sheathing 32 onto horizontal rail 24. This structural assembly is typical of all rails, polymerized sheathing, and slip-on fittings of the present invention.

In a second preferred embodiment of the present invention, a third vertical rail 52 may be provided therewith. Vertical rail 52 is also preferably surrounded by polymerized sheathing 54 having an interior diameter equal to or greater than the exterior diameter of vertical rail 52. Vertical rail 52 is typically provided with base support 56 for supporting vertical rail 52 in an upright position. Base support 56 may be secured to the ground 20 by bolts 22 as typically shown in base supports 16, 18.

Vertical rail 52 with polymerized sheathing 54 may be provided with a cross-shaped slip-on structural fitting 70 for supporting additional horizontal rails 58, 60. These horizontal rails 58, 60 are also preferably surrounded by polymerized sheathing 62, 64 respectively. As with all polymerized sheathing of the present invention, polymerized sheathing 62, 64 has an interior diameter equal to or greater than the exterior diameter of horizontal rails 58, 60. Cross-shaped slip-on structural fitting 70 removably secures horizontal rails 58, 60 with polymerized sheathing 62, 64 to third vertical rail 52 with polymerized sheathing 54 by set screws 72. Horizontal rails 58, 60 with polymerized sheathing 62, 64 are secured to vertical rails 12, 14 with polymerized sheathing 28, 30 by T-shaped slip-on structural fittings 66 with set screws 68.

Proper assembly of the preferred present invention is as follows. Vertical rails 12, 14, 52 are spaced apart and supported in an upright position by base supports 16, 18, 56. These base supports are removably secured to the ground 20 by any mechanical means such as bolts 22. Removable and replaceable polymerized sheathing 28, 30, 54 is preferably slipfit about corresponding vertical rails 12, 14, 52. T-shaped slip-on structural fittings 66 are slipped over polymerized sheathing 28, 30 to be secured and positioned later.

Horizontal rails 24, 26 are provided therewith and surrounded by corresponding polymerized sheathing 32, 34. One end of each horizontal rail is secured to L-shaped slip-on fitting 40 by a corresponding set screw 42. The opposite end of horizontal rails 24, 26 with corresponding polymerized sheathing 32, 34 is secured to a T-shaped slip-on fitting 36 by corresponding set screws 38. The entire removably secured structure of these horizontal rails is then placed atop corresponding vertical rails 12, 14, 52 with polymerized sheathing 28, 30, 54 respectively. Remaining set screws 38, 42 removably attach the horizontal rail structure to the vertical rail structure. Lastly, horizontal rails 58, 60 are surrounded by polymerized sheathing 62, 64 respectively. Each horizontal rail 58, 60 with corresponding polymerized sheathing 62, 64 are removably secured between vertical rails 12, 14, 52 with corresponding polymerized sheathing 28, 30, 54 by slip-on structural fittings 66, 70. Set screws 68, 72 removably engage these additional horizontal rails to the vertical rails at any point along the vertical rails.

Figure 4:
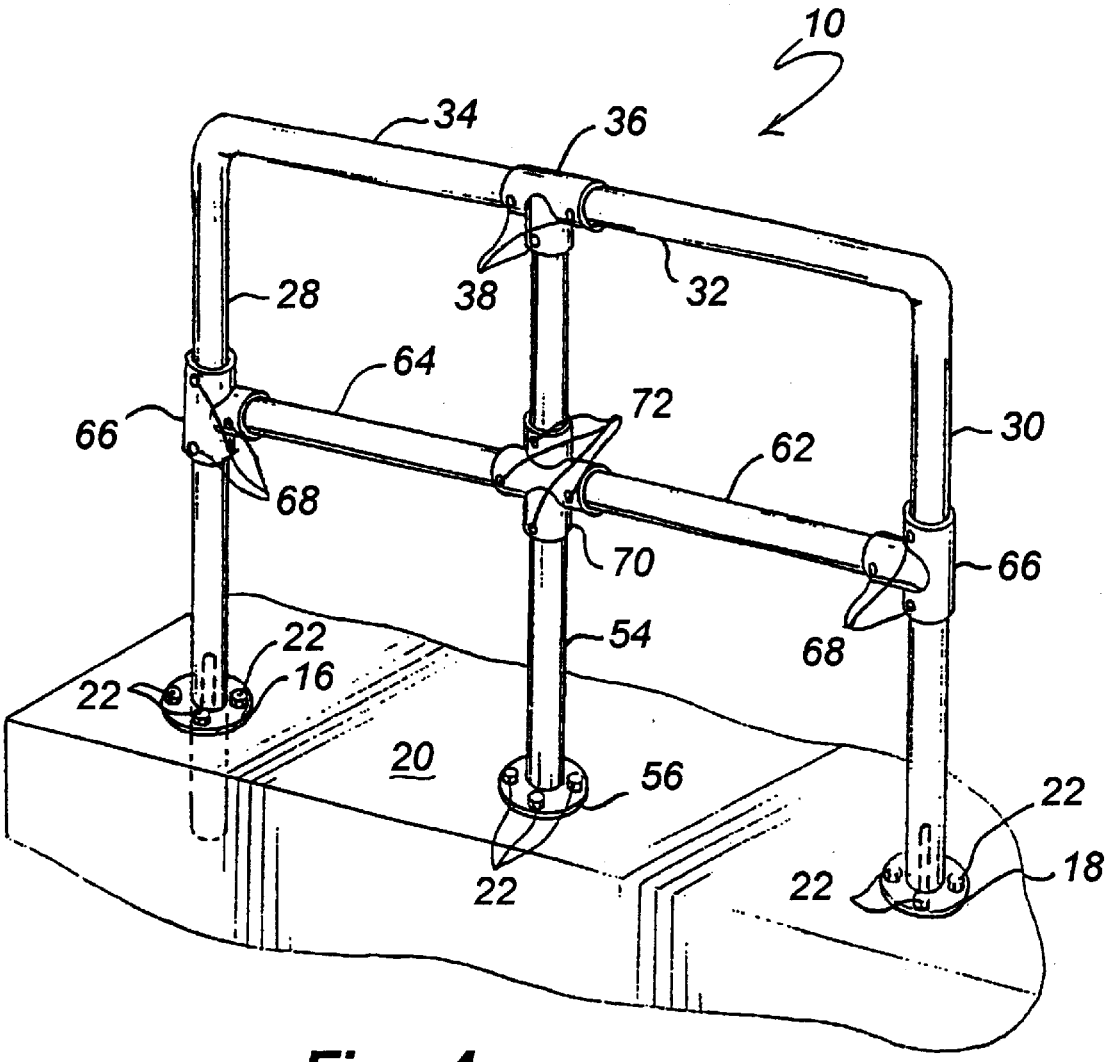
FIG. 4 is a perspective view of a second preferred embodiment of the hand rail assembly of the present invention.

An alternative embodiment of the present invention involves extension and bending of vertical rails 28, 30 to form horizontal rail 34, as shown in FIG. 4. That is, inner frame vertical rail 12, 14 is slip-fit into corresponding polymerized sheathing 28, 30 and is then bent to create a rounded comer and thereby extend into a horizontal rail. In this way, Hollaender fittings 40 would be eliminated and horizontal rails 24, 26 with corresponding polymerized sheathing 32, 34 would be replaced by extended vertical rails 12, 14 with polymerized sheathing 28, 30 to meet at Hollaender fittings 36. In an extended version of this preferred embodiment, Hollaender fitting 36 may be provided to simply support vertical rail 52 with polymerized sheathing 54 to the singularly extended vertical rail 12 with corresponding sheathing 28. In this embodiment, vertical rail 12 would then extend to form both exterior vertical rails 12, 14 and horizontal rails 24, 26. A singular unit of polymerized sheathing would also extend about the singular rail and be bent to form rounded corners at the upper edges.

Alternative embodiments of the present invention may involve the use of only one top horizontal rail or several horizontal and vertical rails extending to create an elongated hand rail assembly 10. It was envisioned that each vertical rail will be removably supported to the ground by a base or structure if necessary. Additional base structures are also shown in FIG. 4. Moreover, each additional horizontal rail is preferably supported to the vertical rails by Hollaender slip-on structural fittings conforming to any shape necessary to create the overall structural shape of the hand rail assembly of the present invention. That is, the hand rail of the present invention may extend linearly, triangularly, circularly, or any other shape that may reasonably be configured. Moreover, each rail, vertical and horizontal, shall preferably be surrounded by polymerized sheathing having an interior diameter that is equal to or greater than the exterior diameter of the corresponding rail.

Figure 5:
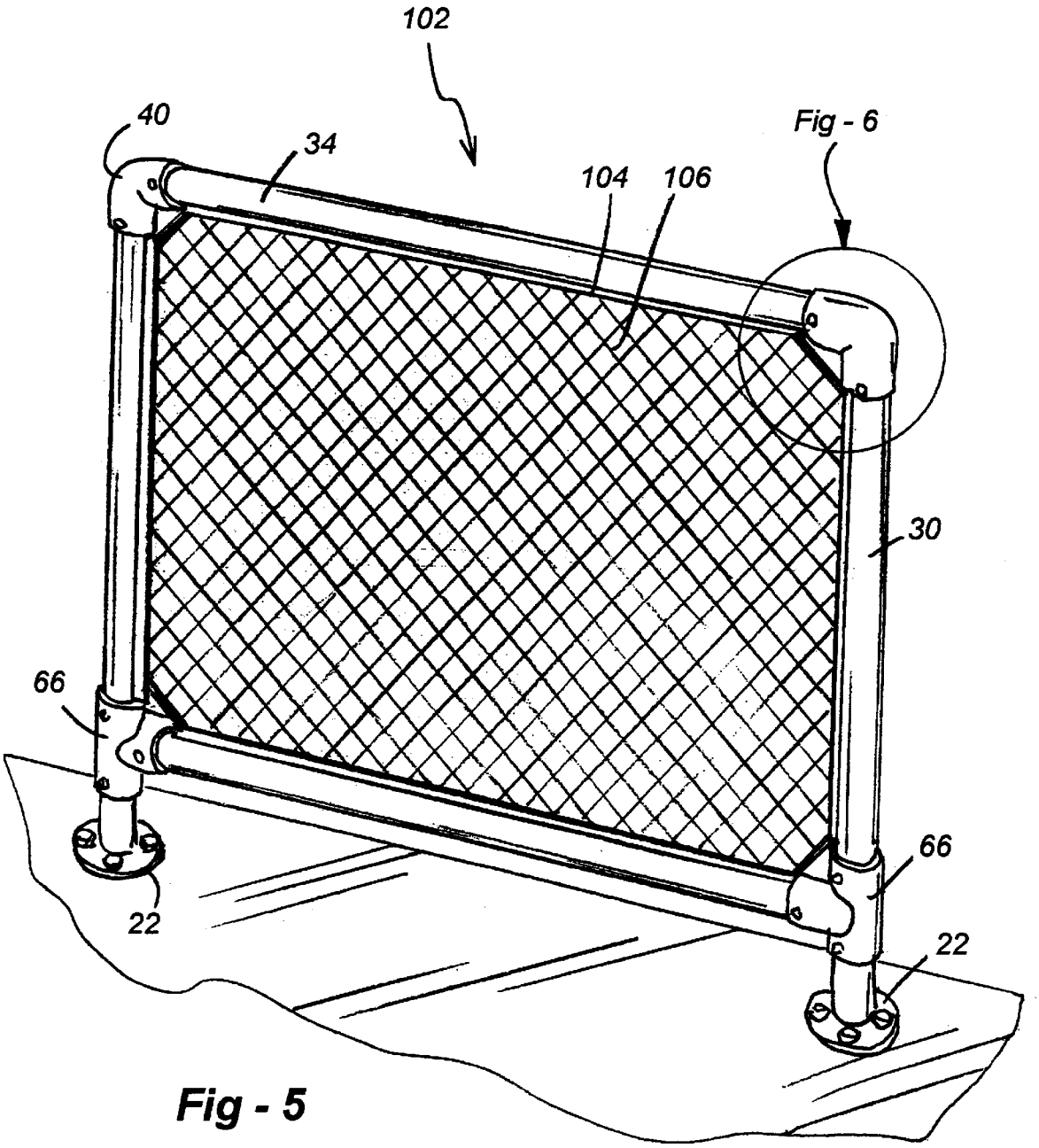
FIG. 5 illustrates, from an oblique perspective, an alternative embodiment of the invention including a mesh infill.

FIG. 5 illustrates, from a perspective view, an alternative embodiment of the invention generally at 102 including an infill disposed between the horizontal and vertical sheathing-covered rails 30 and 34. Although the embodiment depicted in FIGS. 5 and 6 illustrate the use of a mesh panel 106 received by continuous channels 104, it is readily apparent that the arrangement is conducive to the use of other types of infills, including clear and opaque plastics, glass, and meshes and perforated sheets having apertures of any scale, depending upon the application.

Figure 6:
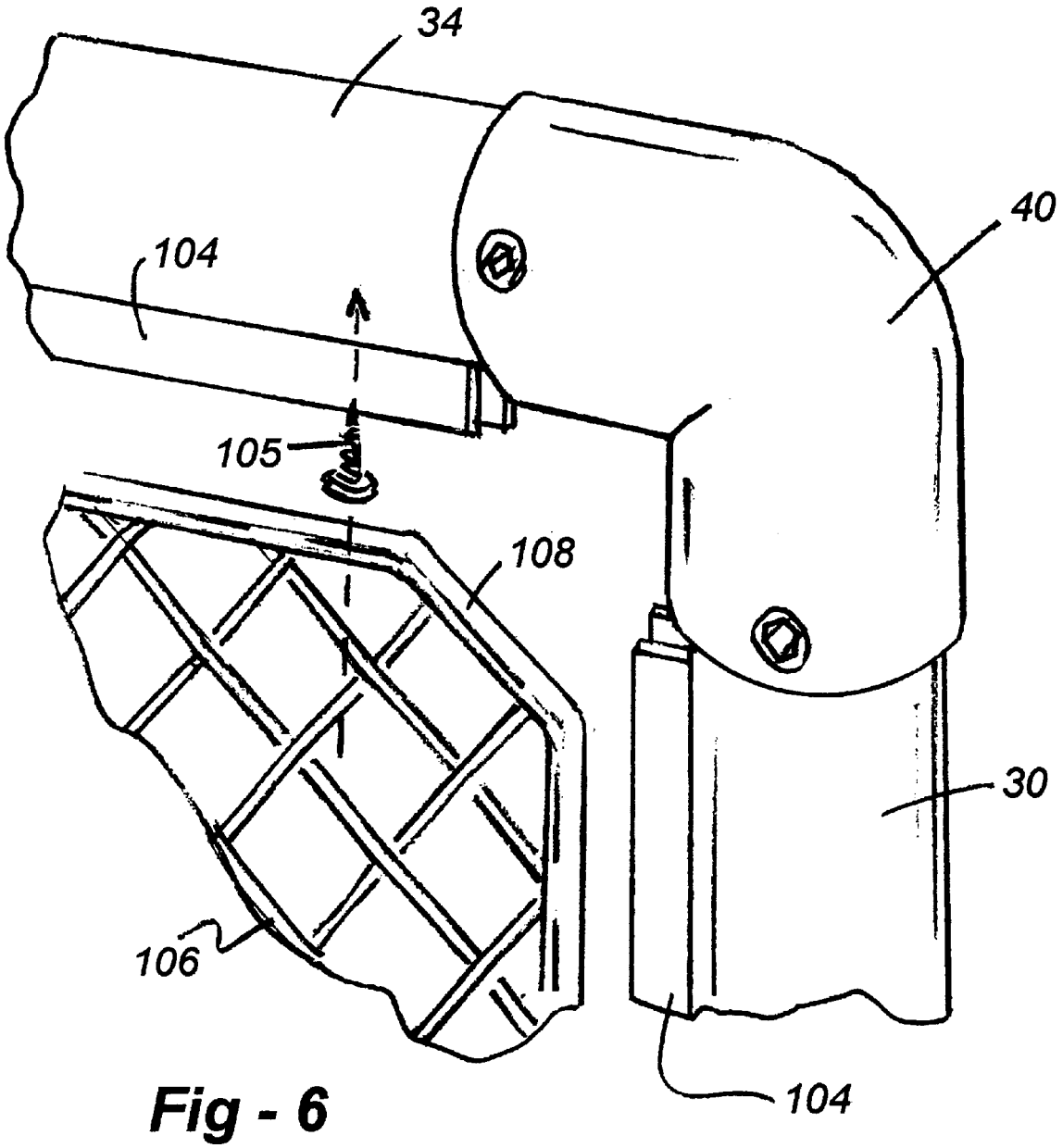
FIG. 6 is a close-up detail of the corner of the assembly of FIG. 5.

FIG. 6 is a close-up view of the way in which the channels 104 attach to the rails 30 and 34, and the way in which infill 106 is received thereby. Preferably, a plurality of spaced-apart self-tapping fasteners 105 are used to adhere the U-channels 104 to the members as shown. Since the fasteners 105 must go through the U-channel material, sheathing and wall of the associated rail, it may be advisable to predrill holes for each fastener, as the case may be. Although the material used for the infill may not include a finished edge, particularly when mesh panels are used, it is preferable to have a peripheral seam 108 to provide a more finished look. In terms of materials, the U-channels 104 are preferably constructed of some type of corrosion-resistant metal such as aluminum, though other types of metals and even non-metals may be used, so long as they are of sufficient strength and durability.

Figure 7:
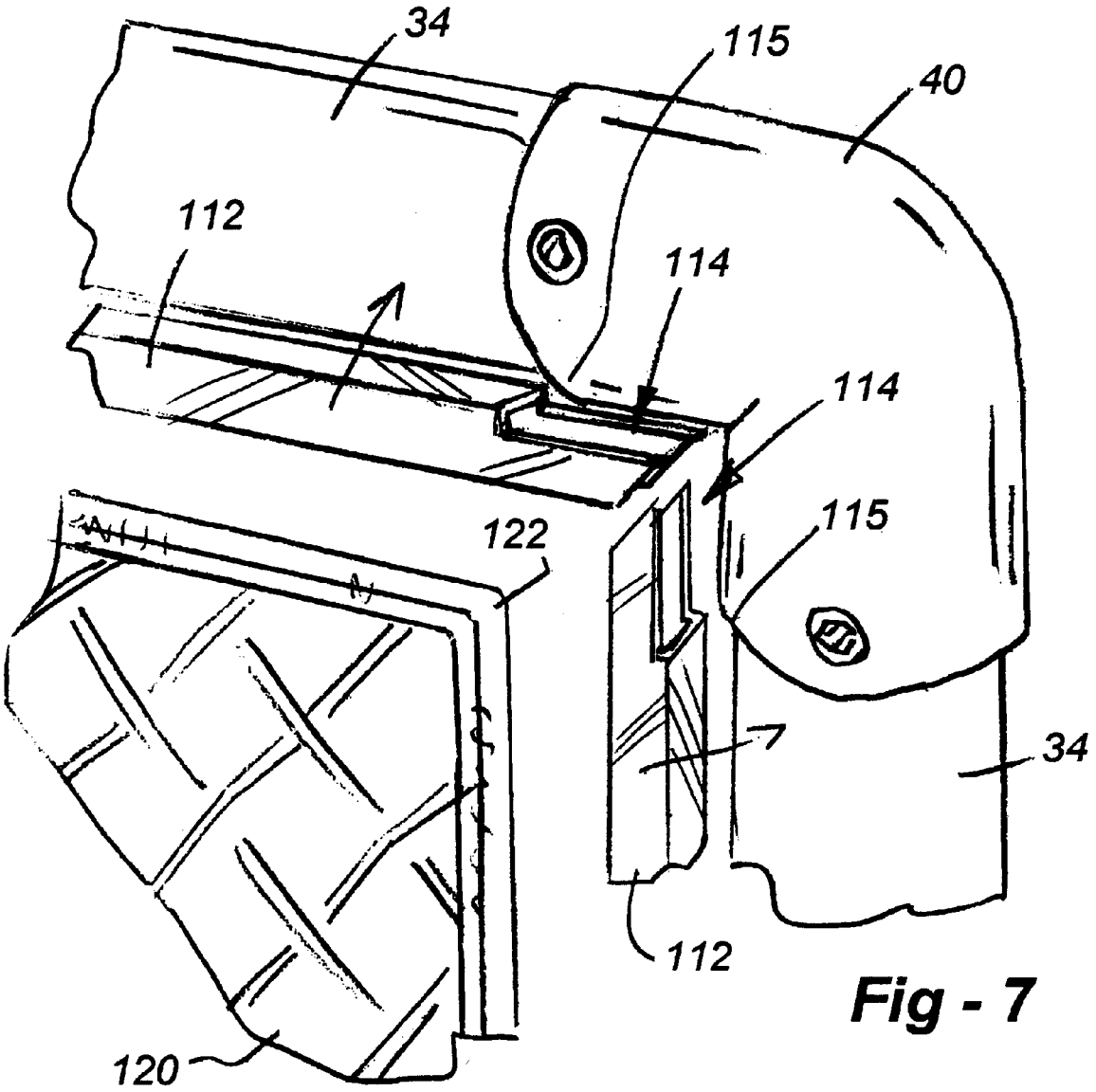
FIG. 7 illustrates an alternative way of forming U-channels according to the invention to ensure that there are no gaps in the infill.

To fill the triangular gap which would otherwise be left due to the difference in height between the sheath covered rails and corner/T-assemblies 40 and 46, a configuration such as that depicted in FIG. 7 may alternatively be utilized. In this case, the U-channels 112 include relieved areas 114 such that, when assembled, a cleaner full corner appearance is achieved. In such a case, an infill having a square corner may be used, such as mesh screen 120 having a finished squared-off corner 122.

Figure 8:
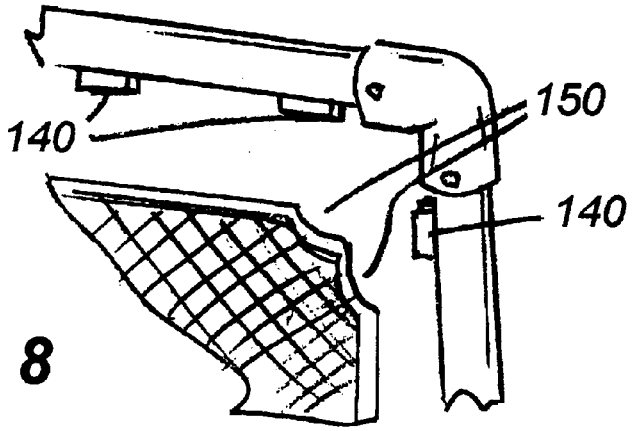
FIG. 8 illustrates the use of clips as opposed to full-length channels, and an alternative corner gap-filling corner configuration.

FIG. 8 illustrates certain additional alternative configurations according to the invention, which may be used independently or in combination with other arrangements described herein. For example, in place of a continuous U-channel, clips 140 may alternatively be used, particularly if the edge of the infill is peripherally finished or otherwise continuous. As a further option, the edge of the infill may be scalloped, as shown at 150. With such a shaped configuration, which may be used with clips or a continuous U-channel, the triangularly shaped gap shown in FIGS. 5 and 6 would be filled without having to grind or otherwise modify the U-channel or clip members.

The above description is considered that of the prefelted embodiment only. Modifications of the invention may occur to those of ordinary skill in the art. Therefore, it is understood that the embodiments shown in the drawing and described above are merely for illustration purposes and is not intended to limit the scope of the invention.

I claim:

1. A knockdown hand rail system comprising:

at least two spaced apart vertical rails;

means for supporting said vertical rails in an upright position;

at least two spaced apart horizontal rails removably engaged with said vertical rails and positioned above said supporting means;

removable and replaceable polymerized sheathing surrounding each of said vertical rails, having an interior diameter equal to or greater than the outer diameter of said vertical rails and extending the height of the vertical rails;

removable and replaceable polymerized sheathing surrounding each of said horizontal rails, said sheathing having an interior diameter equal to or greater than the outer diameter of each of said horizontal rails and extending the length of said horizontal rails; and a plurality of slip-on structural fittings for removably engaging said horizontal rails to said vertical rails, each fitting having a securing mechanism that releasably secures said polymerized sheathing with said rails to said securing mechanism by forming a press fit between them by penetrating said polymerized sheathing without penetrating said rails.

2. The invention defined in claim 1, wherein said fittings for removably engaging said horizontal rails to said vertical rails comprise a T-shaped member;

wherein each leg of said T-shaped member has an interior profile identical to the exterior profile of said horizontal rails and said vertical rails; said interior profile having a diameter equal to or greater than the exterior diameter of said polymerized sheathing surrounding each of said horizontal rails and said vertical rails.

3. The invention as defined in claim 1, wherein said fittings for removably engaging said horizontal rails to said vertical rails comprise an L-shaped member;

wherein each leg of said L-shaped member has an interior profile identical to the exterior profile of said horizontal rails and said vertical rails; said interior profile having a diameter equal to or greater than the exterior diameter of said polymerized sheathing surrounding each of said horizontal rails and said vertical rails.

4. The invention as defined in claim 1, further comprising:

a third vertical rail;

means for supporting said third vertical rail in an upright position;

said at least two spaced apart horizontal rails removably engaged with said third vertical rail and positioned above said supporting means;

removable and replaceable polymerized sheathing surrounding said third vertical rail, said sheathing having an interior diameter equal to or greater than the outer diameter of said third vertical rail and extending the height of said third vertical rail; and slip-on structural fittings for removably engaging said horizontal rails to said third vertical rail.

5. The invention as defined in claim 4, wherein one of said fittings for removably engaging said horizontal rails to said third vertical rail comprises a cross-shaped member;

wherein each leg of said cross-shaped member has an interior profile identical to the exterior profile of said horizontal rails and said third vertical rail; said interior profile having a diameter equal to or greater than the exterior diameter of said polymerized sheathing surrounding each of said horizontal rails and said third vertical rail.

6. The invention defined in claim 4, wherein one of said fittings for removably engaging said horizontal rails to said vertical rails comprises a T-shaped member;

wherein each leg of said T-shaped member has an interior profile identical to the exterior profile of said horizontal rails and said vertical rails; said interior profile having a diameter equal to or greater than the exterior diameter of said polymerized sheathing surrounding each of said horizontal rails and said vertical rails.

7. The invention as defined in claim 1, including three spaced apart vertical rails.

8. The invention as defined in claim 1, wherein said spaced-apart vertical rails and said spaced-apart horizontal rails define an infill area, the invention further including:

an infill member having an area which substantially consumes said infill area; and means for mounting said infill member within said infill area.

9. The invention as defined in claim 8, wherein said means for mounting said infill member within said infill area includes one or more sections of U-channel affixed to each of said vertical and said horizontal rails.

10. The invention as defined in claim 8, wherein said infill member is a mesh screen.

11. The invention as defined in claim 8, wherein said infill member is a solid panel.

12. A knockdown handrail system for protecting people and directing traffic, said knockdown handrail system being formed of at least one modular unit, said modular unit comprising:

a first vertical rail;

means for supporting said vertical rail in an upright position;

a first horizontal rail removably engaged with said vertical rail and positioned above said supporting means;

wherein said vertical rail extends arcuately around said horizontal rail to form a second horizontal rail above said first horizontal rail and to form a second vertical rail opposite said first vertical rail;

a removable and replaceable polymerized sheathing surrounding said vertical rail, said sheathing having an interior diameter equal to or greater than the outer diameter of said vertical rail and extending between said supporting means;

removable and replaceable polymerized sheathing surrounding said horizontal rail, said sheathing having an interior diameter equal to or greater than the outer diameter of said horizontal rail and extending the length of said horizontal rail; and a plurality of slip-on structural fittings for removably engaging said horizontal rail to said vertical rails, said structural fittings having a securing mechanism that releasably secures said polymerized sheathing with said rails to said securing mechanism by forming a press fit between them by penetrating said polymerized sheathing without penetrating said rails.

13. The invention defined in claim 12, wherein said fittings for removably engaging said horizontal rail to said vertical rails each comprise a T-shaped member;

wherein each leg of said T-shaped member has an interior profile identical to the exterior profile of said horizontal rail and said vertical rail; said interior profile having a diameter equal to or greater than the exterior diameter of said polymerized sheathing surrounding each of said horizontal rail and said vertical rail.

14. The invention as defined in claim 12, wherein said knockdown hand rail system further comprises a third vertical rail extending from said supporting means between said first and second vertical rails.

15. The invention as defined in claim 14, further comprising a slip-on structural fitting for removably engaging said horizontal rail to said third vertical rail; said fitting comprising a cross-shaped member having a hollow interior;

wherein each leg of said cross-shaped member has an interior profile identical to the exterior profile of said horizontal rail and said vertical rail; said interior profile having a diameter equal to or greater than the exterior diameter of said polymerized sheathing surrounding each of said horizontal rail and said vertical rail.

16. The invention as defined in claim 12, wherein said spaced-apart vertical rails and said spaced-apart horizontal rails define an infill area, the invention further including:

an infill member having an area which substantially consumes said infill area; and means for mounting said infill member within said infill area.

17. The invention as defined in claim 16, wherein said means for mounting said infill member within said infill area includes one or more sections of U-channel affixed to each of said vertical and said horizontal rails.

18. The invention as defined in claim 16, wherein said infill member is a mesh screen.

19. The invention as defined in claim 16, wherein said infill member is a solid panel.

20. The invention as defined in claim 12, wherein said knockdown hand rail system extends from four to twelve feet in length in even-foot increments.

21. The invention as defined in claim 12, wherein said supporting means for said vertical rail comprises a base plate extending between said rails and removably fixed to the ground, said base plate having an arm extending from said plate into said vertical rail.

* * * * *

UNITED STATES PATENT AND TRADEMARK OFFICE

CERTIFICATE OF CORRECTION

PATENT NO. : 6,283,457 B1
DATED : September 4, 2001
INVENTOR(S) : Frank Venegas, Jr.

It is certified that error appears in the above-identified patent and that said Letters Patent is hereby corrected as shown below:

Column 5,
Line 36, after "rails" insert -- said sheathing --.

Signed and Sealed this

Twenty-fourth Day of June, 2003

JAMES E. ROGAN
*Director of the United States Patent and Trademark Office*